United States Patent [19]

Kendrick

[11] Patent Number: 5,031,161

[45] Date of Patent: Jul. 9, 1991

[54] LIFE EXPECTANCY TIMEPIECE

[76] Inventor: David Kendrick, R.D. #1, Box 285, Berkshire, N.Y. 13736

[21] Appl. No.: 655,590

[22] Filed: Feb. 15, 1991

[51] Int. Cl.[5] ..... G04B 19/24; G04F 8/00

[52] U.S. Cl. ..... 368/280; 368/108

[58] Field of Search ..... 368/27-28, 368/82-84, 107-113, 223, 239-242

[56] References Cited

U.S. PATENT DOCUMENTS 4,518,267 5/1985 Hepp ..... 368/107

4,625,175 11/1986 Smith ..... 368/114

4,853,854 8/1989 Behar et al. ..... 368/10

*Primary Examiner*—Vit W. Miska

*Attorney, Agent, or Firm*—Salzman & Levy

[57] ABSTRACT

A timepiece for monitoring and displaying the approximate time remaining in a user's life. A microprocessor monitors the passage of time. A resettable memory is connected to the processor for storing data representative of years, days, hours, minutes and seconds. A display is connected to the microprocessor for displaying data stored in the memory. Buttons or switches are provided to enter and change the stored data so that the approximate time remaining in the user's life can be reset by the user.

20 Claims, 3 Drawing Sheets

LIFE EXPECTANCY TIMEPIECE

BACKGROUND OF THE INVENTION

The present invention relates to timepieces such as wrist watches and clocks and, more particularly, to a timepiece that displays the number of minutes, days and years remaining in a person's life based on actuarial data.

Life expectancy has been a major concern of people throughout the ages. Insurance companies routinely develop and publish actuarial tables to indicate the average lifespans of certain people in specified groups. This actuarial table data is based on a number of factors, such as overall health of the individual, whether a person smokes cigarettes, consumes excessive alcohol, and genetic factors such as family histories of known diseases and recorded lifespans.

Timepieces that count backwards are also known. For example, U.S. Pat. No. 4,726,687 issued to Gander, discloses a timepiece that includes an analog display. One of a plurality of characters on a data entry dial can be selected to enable an associated coded character on the periphery of a rotatable wheel. A stem is coupled to drive the wheel and to generate a data entry input signal, which is input to a memory associated with an alphanumeric display for visually indicating the entered information or the stored information. Although not disclosed in the reference, the aforementioned patentee indicates that displayed information may include elapsed time from a selected starting time and countdown time remaining to a selected time in the future.

U.S. Pat. No. 4,625,175 issued to Smith discloses a device which measures the open circuit voltage condition of a storage battery to give a reading in increments of time of the remaining useful life of the battery. Although the system does not incorporate the use of an electronic timer, the concept of measuring time backwards is shown.

Heretofore, there has been no way of automatically monitoring one's own life expectancy, based on factors such as actuarial tables, contemporaneous events and heredity.

More precisely, it would be advantageous to predict a person's life expectancy based on factors including health-related activities, such as consuming fatty foods, over-eating, stress, jogging, exercising, etc.

It would also be advantageous to provide a timepiece that would allow one to be apprised of the probable time remaining in one's life.

It would also be advantageous to monitor the probable remaining time left in one's life on a yearly, hourly, and even seconds basis.

It would also be advantageous to provide a lifetime monitoring timepiece that could be resettable by the user.

It would also be advantageous to provide a timepiece for estimating a lifespan of a user, which is settable by programming given events in the user's life.

SUMMARY OF THE INVENTION

In accordance with the present invention, there is provided a timepiece for monitoring and displaying the approximate time remaining in a user's life. A microprocessor monitors the passage of time. A resettable memory is connected to the processor for storing data representative of years, days, hours, minutes and seconds. A display is connected the microprocessor for displaying data stored in the memory. A plurality of buttons or switches is provided to enter and change the stored data so that the approximate time remaining in the user's life can be reset by the user.

BRIEF DESCRIPTION OF THE DRAWINGS

A complete understanding of the present invention may be obtained by reference to the accompanying drawings, when taken in conjunction with the detailed description thereof and in which.

DESCRIPTION OF THE PREFERRED EMBODIMENT

It should be understood that the invention contemplated can be used with wristwatches, clocks or other timepieces, although the wristwatch is the preferred embodiment, and is thus described in greater detail herein.

Figure 1:
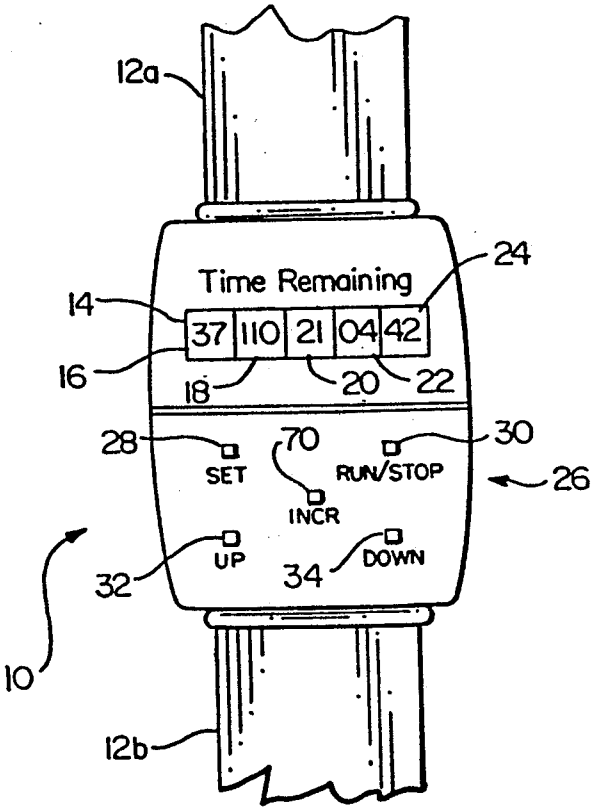
FIG. 1 is a plan view of the preferred embodiment for carrying out the invention.

Referring now to FIG. 1, there is shown a plan view of the timepiece of the preferred embodiment. A watch 10 has conventional wristband portions 12*a* and 12*b* attached to it by conventional means.

A display 14 having a bank of segments is used to display the amount of time remaining in accordance with conventional units of measure.

The display may be one continuous electronic display or a plurality of individually addressable display units. In the preferred embodiment, seven-segment liquid crystal display (LCD) elements are used, although LED displays may also be used, as can nine-segment displays, if desired.

The first field 16 of the display 14 is used to indicate the two-digit year. The next segment 18 of display 14 can represent up to three digits, representing Julian days of the year. The next segment 20 of display 14 is a two-digit field for representing hours. The next segment 22 of display 14 is a two-digit field for indicating minutes. And the last section 24 of display 14 is a two-digit field for displaying seconds.

Below the display portion 14 of timepiece 10 and integrally connected thereto is a plurality of buttons shown generally at reference numeral 26. Four of the buttons indicated in this FIGURE are used respectively: to set the digits in each of the fields 28; to run or to stop the system from counting down 30; to increment the value in the selected field 32; and to decrement the value in the selected field 34.

In operation, run/stop button 30 can be operated by the user to halt the decrementing operation of system. The run/stop button 30 is a toggle switch in the preferred embodiment, which can be activated and deactivated by pressing consecutively. In this way, the decrementing operation ca be halted indefinitely for the time that the user is pursuing a helpful activity (e.g., taking a walk, breathing fresh air, etc.)

Figure 2:
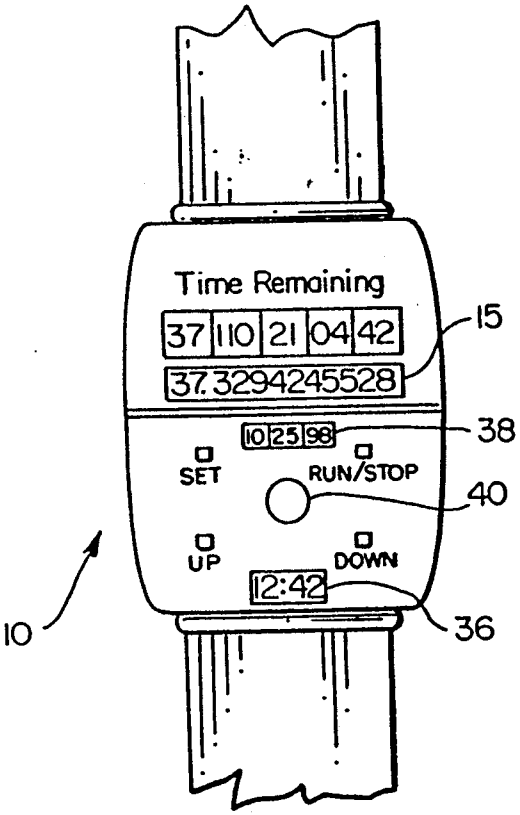
FIG. 2 is a plan view of an alternate embodiment of the timepiece of the invention.

FIG. 2 depicts an alternate embodiment of the invention in which an additional twelve-position LCD display 15 can be used to indicate, in digital form, the number of years of time remaining. Moreover, a time of day display 36 is provided in the instruction/button portion 26 of timepiece 10.

Also provided in the alternate embodiment of the invention (FIG. 2) is a death date indicator 38, which displays the month day and year that the person is expected to expire. A speaker 40 is also provided to generate an audible signal, as a reminder that time is passing. This audible signal may be adapted to operate automatically at a particular time each day or may be suppressed by the user. Such speakers 40 and associated circuitry are well known in the art and need not be described in greater detail herein.

Figure 3:
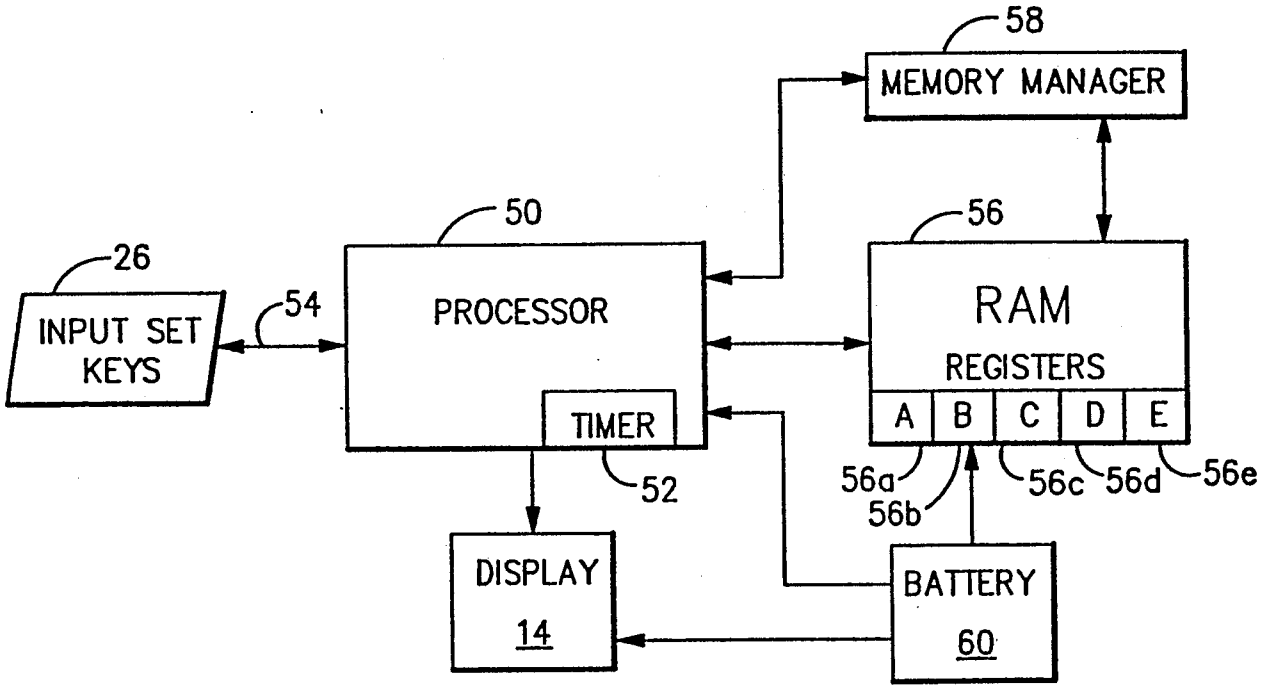
FIG. 3 is a block diagram of the components used to enter and change data.

Referring now also to FIG. 3, there is shown a block diagram of the electronic and mechanical system of the present invention. A processor 50 controls system operations. Processor 50 may be an 8-bit microprocessor such as provided by the Motorola Company. It may also incorporate dividing and decoding functions, as well as a digital driver, as are typically required in the digital timepiece art. Within processor 50 is an oscillator-based timing circuit 52 for generating a timing signal.

The set of input keys 26 is connected to processor 50 by means of bi-directional line 54. Also connected to processor 50 is a random access memory (RAM) device 56 containing a plurality of registers 56*a*, 56*b*, 56*c*, 56*d*, and 56*e*. These registers 56*a*–56*e* each contain locations for storing data representative of year, day, hour, minute and second, respectively. RAM 56 may be a non-volatile memory, which can operate for a period of time without a source of voltage. If, however, RAM 56 is a standard volatile memory device, a memory manager 58 can be provided as backup. In this case, memory manager 58 is refreshed with data in RAM 56 periodically. In the event of failure or replacement of an electric battery 60, the data stored in non-volatile memory manager 58 can then be transferred back to RAM 56 for uninterrupted operation. In this way, the integrity can be maintained of data representative of years, days, hours, minutes and seconds.

The registers 56*a*–56*e* are arranged within RAM 56 to increment the next most significant digit when respective counters have reached their limit. For example, when the seconds register 56*e* reaches a value of 59, register 56*e* is reset to 00 and the value in minutes register 56*d* is incremented. Similarly, when the value in minutes register 56*d* reaches 59, the value in this register 56*d* is reset to 00 and hours register 56*c* is incremented. Hours register 56*c* contains values up to 24. Days register 56*b* contains values up to 365 in the preferred embodiment. It should be understood, however, that with additional circuitry, well known in the art, leap years can be accounted for by allowing days register 56*b* to contain up to 366 days, accessible every four years. Finally, years register 56*a* contains a value up to 99.

In addition to incrementing the most significant value of the next highest field, the system is capable of performing decrementing operations as follows. When a most significant field is decremented, the next least significant is reset to its maximum value. This way, the timepiece can operate by decrementing time values, eventually reducing the values in all registers to 0.

Connected to processor 50 is display 14. In alternate embodiments, other displays may also be connected directly to processor 50.

Finally, a battery 60 is provided to supply power to the main operating components of the system: processor 50, display 14 and RAM 56.

The initial setting of registers 56*a*–56*e* can be accomplished by the process described hereinbelow with respect to FIG. 4. The value(s) entered into the system by the user can be determined by the actuarial Table I data, shown below. It should be understood that as a person becomes older, his expectancy, or projected lifespan shifts. In other words, an American male individual at birth has a life expectancy of just under 71 years, but once having attained the age of 71, his life expectancy has shifted to project a lifespan with an additional 10.39 years, or approximately 81 years. Upon reaching 81, however, the individual will find that the actuarial table, Table I below, now predicts that he has an additional 5.8 years left or, in other words, a new lifespan of approximately 87 years. Therefore, the life expectancy watch of this invention can be periodically updated to constantly shift the lifespan forward accordingly. The shifting of the projected lifespan can be done manually by the user, or the watch may contain an algorithm programmed into the processor 50 that will automatically adjust the projected life expectancy of the individual every day, week or month. The increments used to shift the lifespan by the day, week, month, or year, can be settable by the user, or may be predetermined by the processor program. The increment switch 70 for manually updating overall expectancy can be located on the dial face of watch 10, as shown in FIG. 1. The lifespan actuarial Table I below is typical of shifts in life expectancy in increments of one year.

TABLE I

| | Actuarial Data | |
|---|---|---|
| Present Age (Years) | Life Expectancy Females (Years) | Life Expectancy Males (Years) |
| 0 | 75.83 | 70.83 |
| 1 | 75.04 | 70.13 |
| 2 | 74.11 | 69.20 |
| 3 | 73.17 | 68.27 |
| 4 | 72.23 | 67.34 |
| 5 | 71.28 | 66.40 |
| 6 | 70.34 | 65.46 |
| 7 | 69.39 | 64.52 |
| 8 | 68.44 | 63.57 |
| 9 | 67.48 | 62.62 |
| 10 | 66.53 | 61.66 |
| 11 | 65.58 | 60.71 |
| 12 | 64.62 | 59.75 |
| 13 | 63.67 | 58.80 |
| 14 | 62.71 | 57.86 |
| 15 | 61.76 | 56.93 |
| 16 | 60.82 | 56.00 |
| 17 | 59.87 | 55.09 |
| 18 | 58.93 | 54.18 |
| 19 | 57.98 | 53.27 |
| 20 | 57.04 | 52.37 |
| 21 | 56.10 | 51.47 |
| 22 | 55.16 | 50.57 |
| 23 | 54.22 | 49.66 |
| 24 | 53.28 | 48.75 |
| 25 | 52.34 | 47.84 |
| 26 | 51.40 | 46.93 |
| 27 | 50.46 | 46.01 |
| 28 | 49.52 | 45.09 |
| 29 | 48.59 | 44.16 |
| 30 | 47.65 | 43.24 |
| 31 | 46.71 | 42.31 |
| 32 | 45.78 | 41.38 |
| 33 | 44.84 | 40.46 |
| 34 | 43.91 | 39.54 |
| 35 | 42.98 | 38.61 |
| 36 | 42.05 | 37.69 |
| 37 | 41.12 | 36.78 |
| 38 | 40.20 | 35.87 |
| 39 | 39.28 | 34.96 |
| 40 | 38.36 | 34.05 |
| 41 | 37.46 | 33.16 |

TABLE I-continued

| Present Age (Years) | Actuarial Data Life Expectancy Females (Years) | Life Expectancy Males (Years) |
|---|---|---|
| 42 | 36.55 | 32.36 |
| 43 | 35.66 | 31.38 |
| 44 | 34.77 | 30.50 |
| 45 | 33.88 | 29.62 |
| 46 | 33.00 | 28.76 |
| 47 | 32.12 | 27.90 |
| 48 | 31.25 | 27.04 |
| 49 | 30.39 | 26.20 |
| 50 | 29.53 | 25.36 |
| 51 | 28.67 | 24.52 |
| 52 | 27.82 | 23.70 |
| 53 | 26.98 | 22.89 |
| 54 | 26.14 | 22.08 |
| 55 | 25.31 | 21.29 |
| 56 | 24.49 | 20.51 |
| 57 | 23.67 | 19.74 |
| 58 | 22.86 | 18.99 |
| 59 | 22.05 | 18.24 |
| 60 | 21.25 | 17.51 |
| 61 | 20.44 | 16.79 |
| 62 | 19.65 | 16.08 |
| 63 | 18.86 | 15.38 |
| 64 | 18.08 | 14.70 |
| 65 | 17.32 | 14.04 |
| 66 | 16.57 | 13.39 |
| 67 | 15.83 | 12.76 |
| 68 | 15.10 | 12.14 |
| 69 | 14.38 | 11.54 |
| 70 | 13.67 | 10.96 |
| 71 | 12.97 | 10.39 |
| 72 | 12.28 | 9.84 |
| 73 | 11.60 | 9.30 |
| 74 | 10.95 | 8.79 |
| 75 | 10.32 | 8.31 |
| 76 | 9.71 | 7.84 |
| 77 | 9.12 | 7.40 |
| 78 | 8.55 | 6.97 |
| 79 | 8.01 | 6.57 |
| 80 | 7.48 | 6.18 |
| 81 | 6.98 | 5.80 |
| 82 | 6.49 | 5.44 |
| 83 | 6.03 | 5.09 |
| 84 | 5.59 | 4.77 |
| 85 | 5.18 | 4.46 |
| 86 | 4.80 | 4.18 |
| 87 | 4.43 | 3.91 |
| 88 | 4.09 | 3.66 |
| 89 | 3.77 | 3.41 |
| 90 | 3.45 | 3.18 |
| 91 | 3.15 | 2.94 |
| 92 | 2.85 | 2.70 |
| 93 | 2.55 | 2.44 |
| 94 | 2.24 | 2.17 |
| 95 | 1.91 | 1.87 |
| 96 | 1.56 | 1.54 |
| 97 | 1.21 | 1.20 |
| 98 | .84 | .84 |
| 99 | .50 | .50 |

Likewise, registers 56a–56e can be reset based upon data in health factor Table II, shown below.

TABLE II

| Factor | Health Factors Life Expectancy Adjustment (Years) |
|---|---|
| Family History: | |
| Father | +1/each year above 70 your father lived |
| Mother | +1/each year above 70 your mother lived |
| Marital Status: | |
| Married | +5 |
| Unmarried and older than 25 yrs. | −1/unmarried decade |
| Residence: | |
| Small Town | +4 |
| City | −2 |
| Economic Status: | |
| Wealthy | −3 |
| Poor | −3 |
| Your Shape | −1/each 5 lbs overweight −2/each inch girth exceeds chest measurement |
| Exercise: | |
| Regular and Moderate | +3 |
| Regular and Vigorous | +5 |
| Disposition: | |
| Good-natured/Placid | +1 to +5 |
| Tense and Nervous | −1 to −5 |
| Alcohol: | |
| Heavy Drinker | −5 |
| Very Heavy Drinker | −10 |
| Smoking: | |
| ¼ to 1 Pack per day | −3 |
| 1 to 1¼ | −5 |
| More than 1¼ | −10 |
| Pipe or Cigar | −2 |
| Regular Medical & Dental Checkups | +3 |
| Frequent Illness | −2 |

Other factors may also be programmed into the system. A separate display (not shown) or one of the existing displays 14, 15 can be used to question the individual as to the various health factors. The questioning display can be invoked by pressing both UP and DOWN buttons 32 and 34, simultaneously. A menu of such questions, based on the factors included in Table II above, is preprogrammed, residing in RAM 56 (FIG. 3) under control of processor 50.

Figure 4:
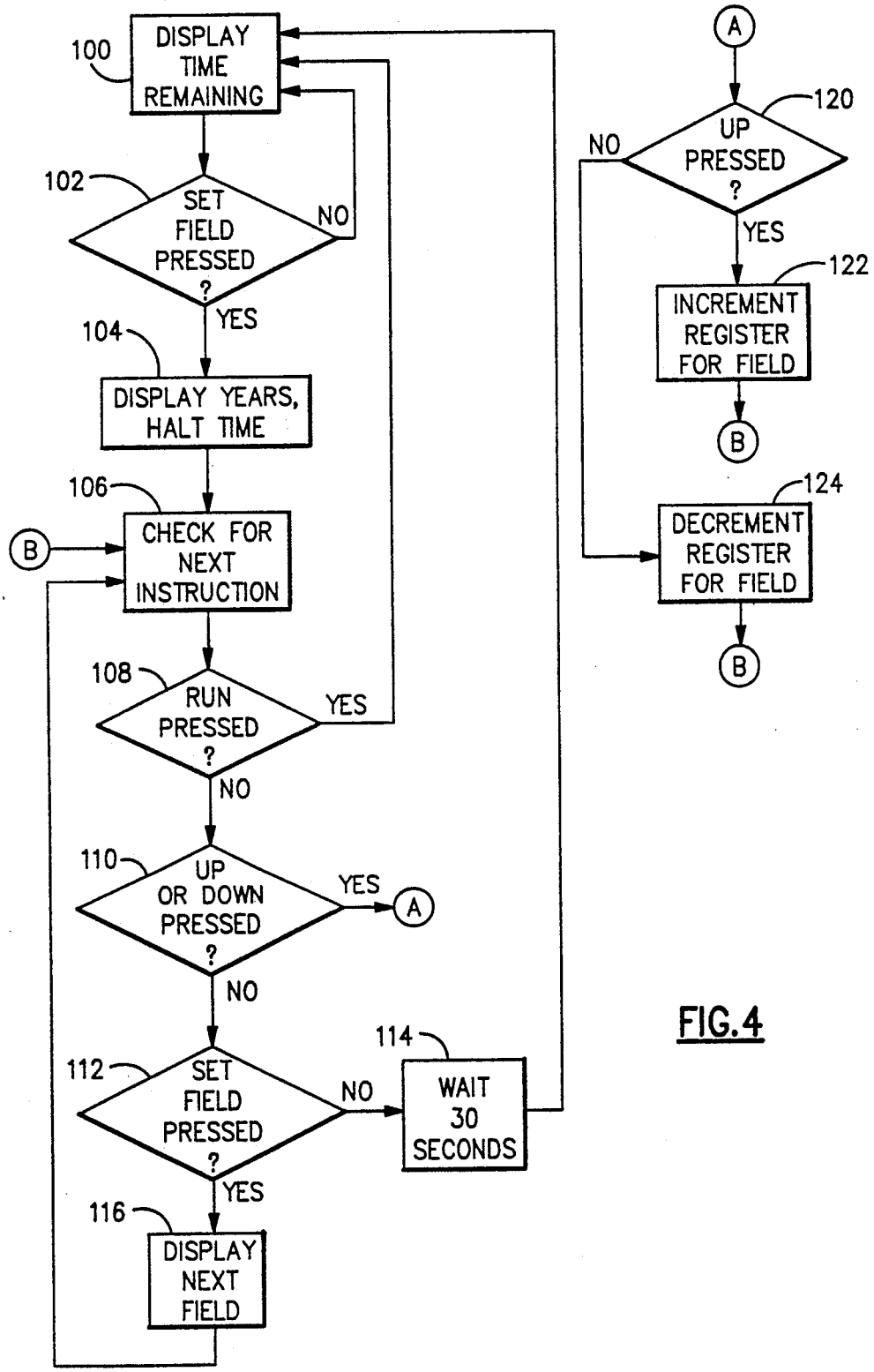
FIG. 4 is a flow chart of operations that occur in the processor shown in FIG. 3.

Referring now also to FIG. 4, there is shown a flow chart of operations of processor 50 (FIG. 1) during a setting/resetting operation. The time remaining is displayed on display 14 continuously, step 100. If no set/-field key 26 is pressed, step 102, the system continues to execute the tightly controlled loop and display the time remaining. If, however, the set/field key 28 is pressed, step 102, the system displays the number of years, step 104, and halts the time decrementing operation.

The system then checks for any additional instructions, step 106. If the run/stop key 30 is pressed, step 108, the system returns control to processor 50 for displaying the time remaining continuously, step 100. If, however, the run/stop key 30 is not pressed, step 108, the system determines whether the up key 32 or down key 34 is pressed, step 110. If neither up key 32 nor down key 34 has been pressed, step 110, the system determines whether the set/field key 28 has been pressed, step 112. If such is not the case, the system suspends operation for 30 seconds, step 114, and returns control to processor 50 for displaying the time remaining continuously, step 100. If, however, the set/field key 28 has been pressed, step 112, the system displays the next field, step 116 (i.e., the days field 18, the hours field 20, the minutes field 22, and the seconds field 24, respectively) and the loop from step 106 to 116 continues to be executed.

If the up key 32 or the down key 34 is pressed, step 110, the system executes a subroutine shown as letter A in the FIGURE. In this subroutine, the system determines whether the up key 32 is pressed, step 120. If so, the appropriate memory register under consideration 56a–56e is incremented, step 122. Control then returns to processor 50 to check for the next instruction, step 106. If, however, the up key is not pressed, step 120, that indicates that the down key 34 must have been pressed, in which case the appropriate register corresponding to the field under consideration 56a–56e is decremented, step 124. Once again, control returns to system processor 50 to check for the next instruction, step 106.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be covered by Letters Patent is presented by the subsequently appended claims.

What is claimed is:

1. A time monitoring apparatus for monitoring and displaying an approximate time remaining in a lifespan of an individual, said monitoring apparatus programmed to decrement time units from an actuarially determined lifespan and to shift a projected lifespan value as the individual grows older, said time monitoring apparatus comprising:

(a) processing means for monitoring the passage of time, and programmed with an actuarial table algorithm for projecting a lifespan value for an individual, said program further shifting said lifespan value as the individual grows older and said time is monitored;

(b) a resettable memory operatively connected to said processing means for storing data representative of years, days, hours, minutes, and seconds;

(c) display means operatively connected to said processing means for displaying data stored in said resettable memory; and (d) means operatively connected to said processing means for entering and changing said stored data based upon characteristics specific to said individual, whereby an approximate time remaining in the lifespan of said individual can be reset by said individual.

2. The time monitoring apparatus of claim 1, contained within a watch to be worn by said individual.

3. The time monitoring apparatus of claim 1, further comprising increment shifting means for manually changing shifting increments whereby said lifespan value can be shifted in increments of days, hours, weeks, months or years.

4. The time monitoring apparatus of claim 3, wherein said program automatically increments shifting said lifespan value every day, hour, week, month or year in accordance with setting of said increment shifting means.

5. The time monitoring apparatus of claim 1, further comprising interrogating means for interrogating the individual concerning lifespan value changing data and information, whereby said individual can enter data and information based upon said interrogation into said resettable memory to change said lifespan value.

6. The time monitoring apparatus of claim 1, wherein said display means comprises an LCD.

7. The time monitoring apparatus of claim 1, wherein said resettable memory comprises incrementing and decrementing registers.

8. The time monitoring apparatus of claim 1, wherein said display is digital.

9. A time monitoring apparatus for monitoring and displaying an approximate time remaining in a lifespan of an individual, said monitoring apparatus programmed to decrement time units from an actuarially determined lifespan, said time monitoring apparatus comprising:

(a) processing means for monitoring the passage of time, and programmed with an actuarial table algorithm for projecting a lifespan value for an individual;

(b) a resettable memory comprising incrementing and decrementing registers operatively connected to said processing means for storing data representative of years, days, hours, minutes, and seconds;

(c) display means operatively connected to said processing mean for displaying data stored in said resettable memory; and (d) means operatively connected to said processing means for entering and changing said stored data based upon characteristics specific to said individual, whereby an approximate time remaining in the lifespan of said individual can be reset by said individual.

10. The time monitoring apparatus of claim 9, contained within a watch to be worn by said individual.

11. The time monitoring apparatus of claim 9, further comprising increment shifting means for manually changing shifting increments whereby said lifespan value can be shifted in increments of days, hours, weeks, months or years.

12. The time monitoring apparatus of claim 11, wherein said program automatically increments shifting said lifespan value every day, hour, week, month or year in accordance with setting of said increment shifting means.

13. The time monitoring apparatus of claim 9, further comprising interrogating means for interrogating the individual concerning lifespan value changing data and information, whereby said individual can enter data and information based upon said interrogation into said resettable memory to change said lifespan value.

14. The time monitoring apparatus of claim 9, wherein said display means comprises an LCD.

15. The time monitoring apparatus of claim 9, wherein said display is digital.

16. A digital time monitoring apparatus for monitoring and displaying an approximate time remaining in a lifespan of an individual, said monitoring apparatus programmed to decrement time units from an actuarially determined lifespan and to shift a projected lifespan value as the individual grows older, said time monitoring apparatus comprising:

(a) processing means for monitoring the passage of time, and programmed with an actuarial table algorithm for projecting a lifespan value for an individual, said program further shifting said lifespan value as the individual grows older and said time is monitored;

(b) a resettable memory comprising incrementing and decrementing registers operatively connected to said processing means for storing data representative of years, days, hours, minutes, and seconds;

(c) digital display means operatively connected to said processing means for displaying data stored in said resettable memory; and (d) means operatively connected to said processing means for entering and changing said stored data based upon characteristics specific to said individual, whereby an approximate time remaining in the lifespan of said individual can be reset by said individual.

17. The time monitoring apparatus of claim 16, contained within a watch to be worn by said individual.

18. The time monitoring apparatus of claim 16, further comprising increment shifting means for manually changing shifting increments whereby said lifespan value can be shifted in increments of days, hours, weeks, months or years.

19. The time monitoring apparatus of claim 18, wherein said program automatically increments shifting said lifespan value every day, hour, week, month or year in accordance with setting of said increment shifting means.

20. The time monitoring apparatus of claim 16, further comprising interrogating means for interrogating the individual concerning lifespan value changing data and information, whereby said individual can enter data and information based upon said interrogation into said resettable memory to change said lifespan value.

* * * * *